US007552511B2

(12) United States Patent
Campbell et al.

(10) Patent No.: US 7,552,511 B2
(45) Date of Patent: Jun. 30, 2009

(54) ADJUSTABLE HINGE

(75) Inventors: Frank W Campbell, Lake Elmo, MN (US); Bror Fries, Hishult (SE)

(73) Assignee: Creative Research & Development, Inc., Lake Elmo, MN (US)

( * ) Notice: Subject to any disclaimer, the term of this patent is extended or adjusted under 35 U.S.C. 154(b) by 231 days.

(21) Appl. No.: 11/495,178

(22) Filed: Jul. 28, 2006

(65) Prior Publication Data

US 2008/0022491 A1 Jan. 31, 2008

(51) Int. Cl.
*E05D 7/04* (2006.01)

(52) U.S. Cl. ..... 16/238; 16/258; 16/236; 16/237; 16/240

(58) Field of Classification Search ..... 16/236, 16/237, 238, 248, 249, 231, 232, 257, 258
See application file for complete search history.

(56) References Cited

U.S. PATENT DOCUMENTS

| | | | | |
|---|---|---|---|---|
| 994,196 | A | 6/1911 | Reddick | |
| 1,002,394 | A | 9/1911 | Hanson | |
| 2,940,115 | A | 6/1960 | Hansen | |
| 3,325,942 | A | 6/1967 | Bejarano | |
| 3,423,786 | A | 1/1969 | Arias, Jr. et al. | |
| 3,728,758 | A | 4/1973 | Johansen | |
| 3,952,366 | A | 4/1976 | Rock et al. | |
| 4,070,728 | A | 1/1978 | Herman | |
| 4,159,557 | A | 7/1979 | Pittasch et al. | |
| 4,825,507 | A | 5/1989 | Killingstad | |
| 4,982,475 | A | 1/1991 | Killingstad | |
| 5,339,493 | A * | 8/1994 | MacIntyre | 16/238 |
| 5,379,487 | A | 1/1995 | Bowers | |
| 5,381,920 | A | 1/1995 | Lin | |
| 5,632,064 | A | 5/1997 | Lautenschlager | |
| 5,646,708 | A | 7/1997 | Bolle | |
| 5,701,636 | A * | 12/1997 | Jahnke | 16/238 |
| 5,713,105 | A * | 2/1998 | Toomey | 16/245 |
| 5,788,351 | A | 8/1998 | Prunty et al. | |
| 5,799,370 | A | 9/1998 | Davidian et al. | |
| 5,806,144 | A | 9/1998 | Fries | |
| 6,202,255 | B1 | 3/2001 | Sitter | |
| 6,553,621 | B2 | 4/2003 | Isele | |
| 6,715,181 | B1 * | 4/2004 | Fries | 16/271 |
| 7,334,293 | B2 * | 2/2008 | Erickson et al. | 16/243 |
| 7,350,272 | B2 | 4/2008 | Fries | |
| 2006/0260096 | A1 | 11/2006 | Fries | |
| 2007/0143959 | A1 * | 6/2007 | Chung | 16/236 |

FOREIGN PATENT DOCUMENTS

| | | |
|---|---|---|
| DK | 132347 | 11/1975 |
| EP | 1 094 183 A2 | 4/2001 |
| NO | 309619 | 2/2001 |
| WO | WO 01/84261 | 11/2001 |
| WO | WO 03/029589 A1 | 4/2003 |

* cited by examiner

*Primary Examiner*—Victor Batson
*Assistant Examiner*—Jeffrey O'Brien
(74) *Attorney, Agent, or Firm*—IPLM Group, P.A.

(57) ABSTRACT

An adjustable hinge (10) has a frame leaf (11) with a door leaf (14) rotatably mounted thereto. An adjustable mounting assembly (21) has a snap-in connection to the door leaf (14). A slideable carriage (24) is utilized. Vertical adjustment is provided by a bevel gear assembly (25). Horizontal adjustment is provided through a screw (17) which pivots the door leaf (14).

17 Claims, 11 Drawing Sheets

ADJUSTABLE HINGE

BACKGROUND OF THE INVENTION

1. Field of the Invention

This invention relates generally to an adjustable hinge and more particularly to an adjustable hinge that is adjustable in the vertical and/or horizontal direction.

2. Description of the Prior Art

A number of different adjustable hinges have been used to adjust doors relative to the frames in which the doors are mounted. This allows the doors to be level and fit well within the frame. These adjustable hinges may be of the standard variety or a snap-in variety. Adjustable hinges are often more complex and are of greater difficulty to install than non-adjustable hinges. In addition, the adjustable hinges are often time-consuming and somewhat difficult to adjust in manipulating the adjustment mechanisms.

The present invention addresses issues in the prior art and provides for a novel hinge with new features that may be utilized for adjustable hinges of the standard variety as well as of the snap-in variety.

SUMMARY OF THE INVENTION

In one embodiment the invention is an adjustable hinge for pivotally mounting a door to a frame. The adjustable hinge includes a first leaf adapted and configured to be mounted on one of a frame and a door. An adjustable mounting assembly is adapted and configured to be mounted on the other of the frame and door. The adjustable mounting assembly includes a housing defining an inner cavity. A slideable carriage is positioned in the inner cavity. The carriage generally is contained in the inner cavity by the housing. A second leaf has a first end operatively connected to the first leaf and is rotatably connected thereto. The second leaf has a second end operatively connected to the adjustable mounting assembly.

In another embodiment the invention is an adjustable hinge for pivotally mounting a door to a frame. A first leaf is adapted and configured to be mounted on one of a frame and a door. An adjustable mounting assembly is adapted and configured to be mounted on the other of the frame and the door. The adjustable mounting assembly includes a housing defining a receptor cavity. A latch is positioned in the mounting assembly, the latch is biased to a latch position. The latch is moveable between the latch position and an unlatched position. A second leaf has a first end operatively connected to the first leaf and is rotatably connected thereto. The second leaf has a second end operatively connected to the adjustable mounting assembly with a snap-in connection. A second leaf has a leading edge, a top edge and a bottom edge. One of the top edge and bottom edge having a latch-receiving opening, wherein the latch engages the second leaf along one of the top and the bottom edges.

In another embodiment the invention is an adjustable hinge for pivotally mounting a door to a frame. A first leaf is adapted and configured to be mounted on one of a frame and a door. An adjustable mounting assembly is adapted and configured to be mounted on the other of the frame and door. The adjustable mounting assembly includes a housing defining a receptor cavity. A latch is positioned in the mounting assembly, the latch biased to a latch position. The latch is moveable between the latch position and an unlatched position. A second leaf has a first end operatively connected to the first leaf and rotatably connected thereto. The second leaf has a second end operatively connected to the adjustable mounting assembly with a snap-in connection. The second leaf has a latch receiving opening, wherein the latch engages the second leaf. The second leaf has an inside surface and an outside surface and a threaded bore extending between the surfaces. The threaded bore is proximate the leading edge. A screw is rotatably mounted in the threaded bore and there is a first access opening in the housing to allow for rotating the screw, thereby pivoting the second leaf and horizontally adjusting the hinge.

In another embodiment the invention has an adjustable hinge for pivotally mounting a door to a frame. A first leaf is adapted and configured to be mounted on one of a frame and a door. An adjustable mounting assembly is adapted and configured to be mounted on the other of the door and frame. The adjustable mounting assembly includes a housing defining an inner cavity. A slideable carriage is positioned in the inner cavity, the carriage generally constrained in the inner cavity by the housing. A second leaf has a first end operatively connected to the first leaf and rotatably connected to thereto. The second leaf has a second end operatively connected to the slideable carriage. A first bevel gear is positioned in the housing, the housing having a second access opening allowing for rotation of the first bevel gear. The second bevel gear is coupled to the first bevel gear. A rod has a threaded end. The rod is rotated by the second bevel gear. A threaded member is operatively connected to the carriage, the threaded member positioned on the threaded end of the rod, wherein rotation of the first bevel gear rotates the rod within the threaded member and thereby moves the carriage vertically.

DETAILED DESCRIPTION OF A PREFERRED EMBODIMENT

Figure 1:
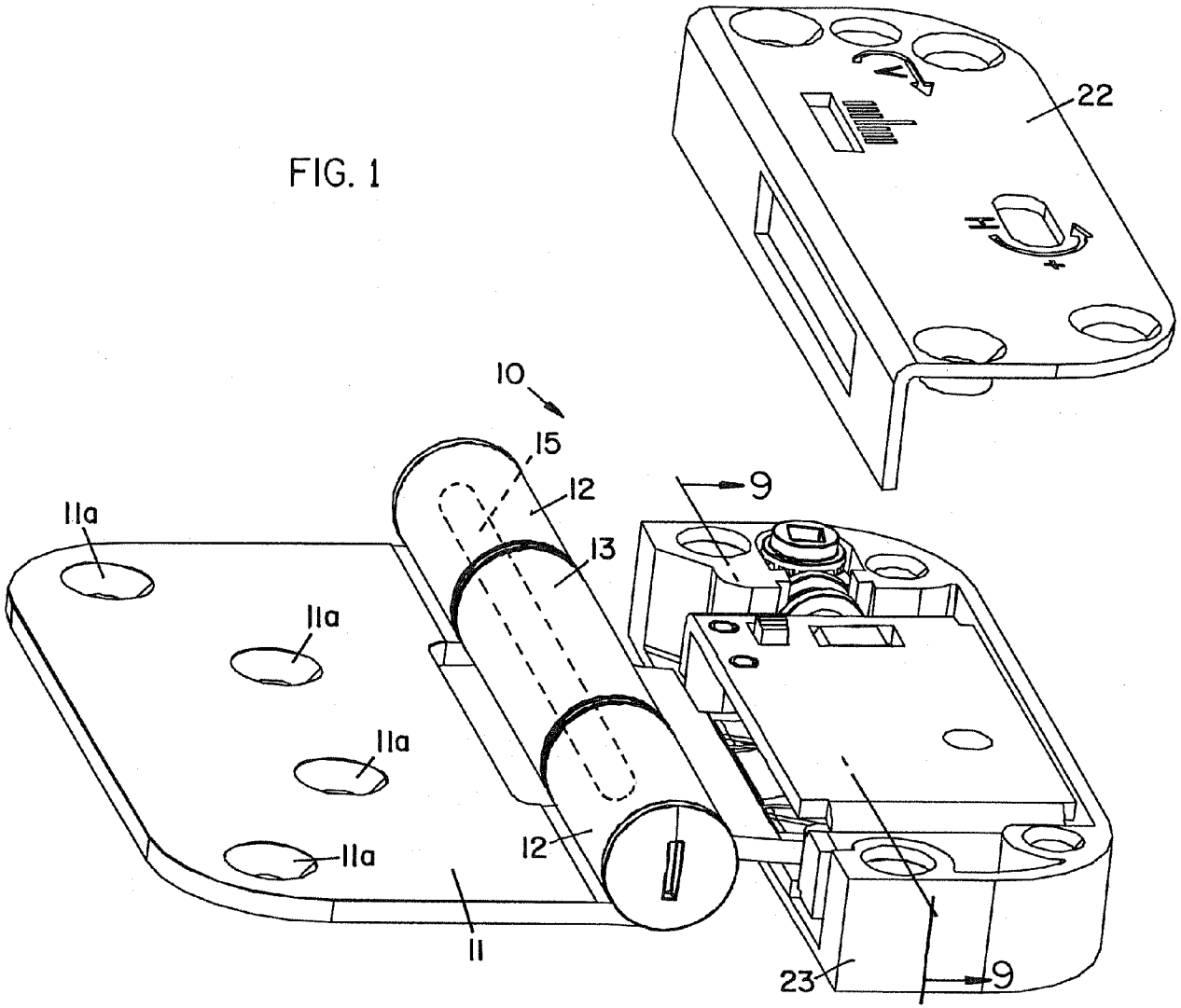
FIG. 1 is perspective view of the present invention shown with the cover exploded away.
Figure 2:
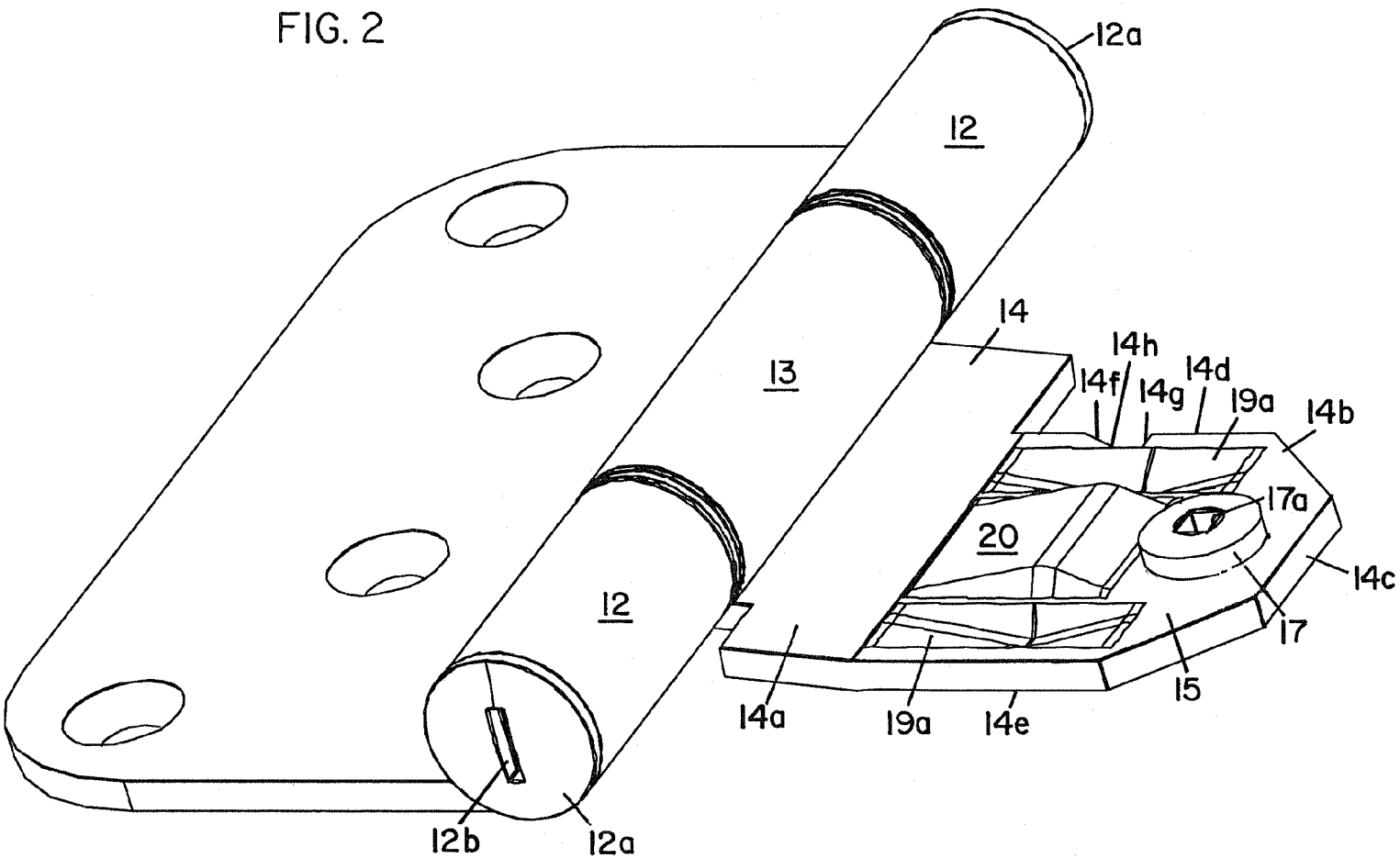
FIG. 2 is a perspective view of the frame leaf and door leaf, shown in FIG. 1.
Figure 3:
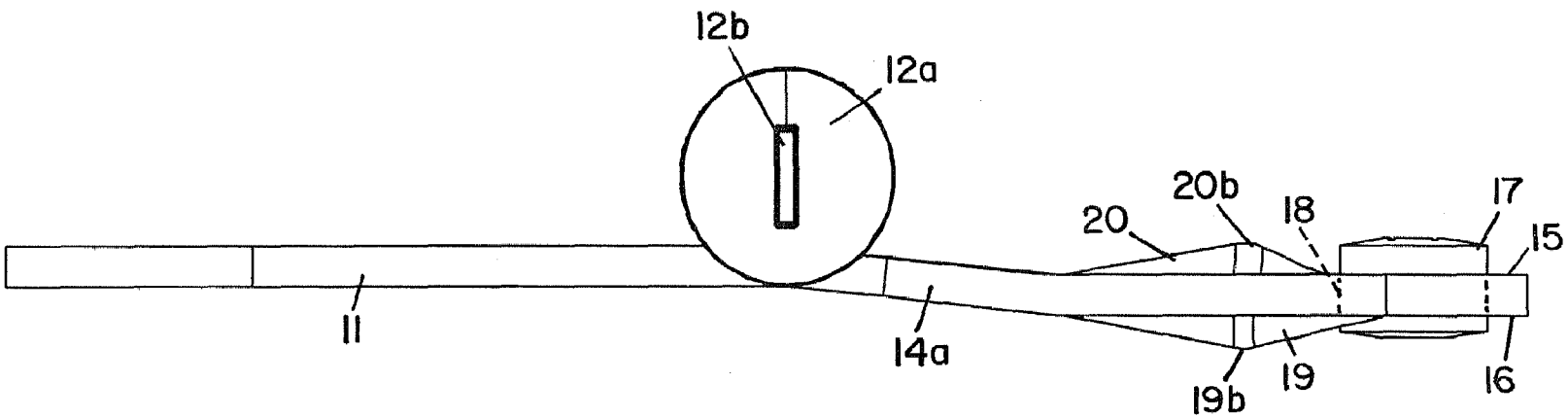
FIG. 3 is side elevational view of the leaves shown in FIG. 2.

Referring to the drawings, wherein like numerals represent like parts throughout the several views, there is generally disclosed at 10 an adjustable hinge. The adjustable hinge 10 includes a frame leaf 11 having a plurality of mounting holes 11 a formed therein. The mounting holes are used to secure the frame leaf 11 to a frame (not shown). The frame leaf 11 is generally planar and suitable mounting screws or other mounting mechanisms may be utilized. The frame leaf 11 has two spaced knuckles 12 that are operatively connected to the frame leaf 11. The spaced knuckles 12 mate with a knuckle 13 on door leaf 14. End caps 12*a* may be provided to provide a finished look to the knuckles 12. The end caps 12*a* are optionally threaded so that they may be screwed into the knuckles 12. The end caps 12*a* have a slot 12*b* into which a tool is inserted to install and remove the end caps 12*a*. A threaded bore extends through the knuckles 12 and 13 and the leaves 11 and 14 are engaged together with a pivot pin 15 which enables the leaves 11, 14 to pivot with respect to each other. The door leaf 14 has a base member 14*a* that is operatively connected to the knuckle 13. Operatively connected, and preferably integral with the base member 14*a* is an insertion member 14*b*. The insertion end 14*b* has a leading edge 14*c*, a top edge 14*d* and a bottom edge 14*e*. A latch receiving opening 14*f* is formed in the top edge 14*d*. The latch receiving opening 14*f* has an end wall 14*g* that is generally parallel to the pin 15. An angled side wall 14*h* is generally at an angle to the end wall 14*g*. The door leaf 14 has a top surface 15 and a bottom surface 16. A threaded bore 18 extends from the top surface 15 to the bottom surface 16. A screw 17 is threaded into the threaded bore 18. The screw 17 has an opening 17*a* in which a tool, such as a screwdriver or Allen wrench, may be inserted to rotate the screw 17 in the threaded bore 18. The insert member 14*b* is generally flat. However, three coined areas are formed in the insertion member 14*b*. Two smaller rectangular-shaped coined protrusions 19 protrude from the bottom surface 16 and are formed with their corresponding depressions 19*a* on the top surface 15. Another coined protrusion 20 extends upward, as viewed in FIG. 2, from the top surface 15 and the corresponding depression is formed on the bottom surface 16. The protrusions 19 are downward, as viewed in FIG. 2. The protrusions 19 and 20 have rounded, or pointed, apexes 19*b* and 20*b*.

Figure 4:
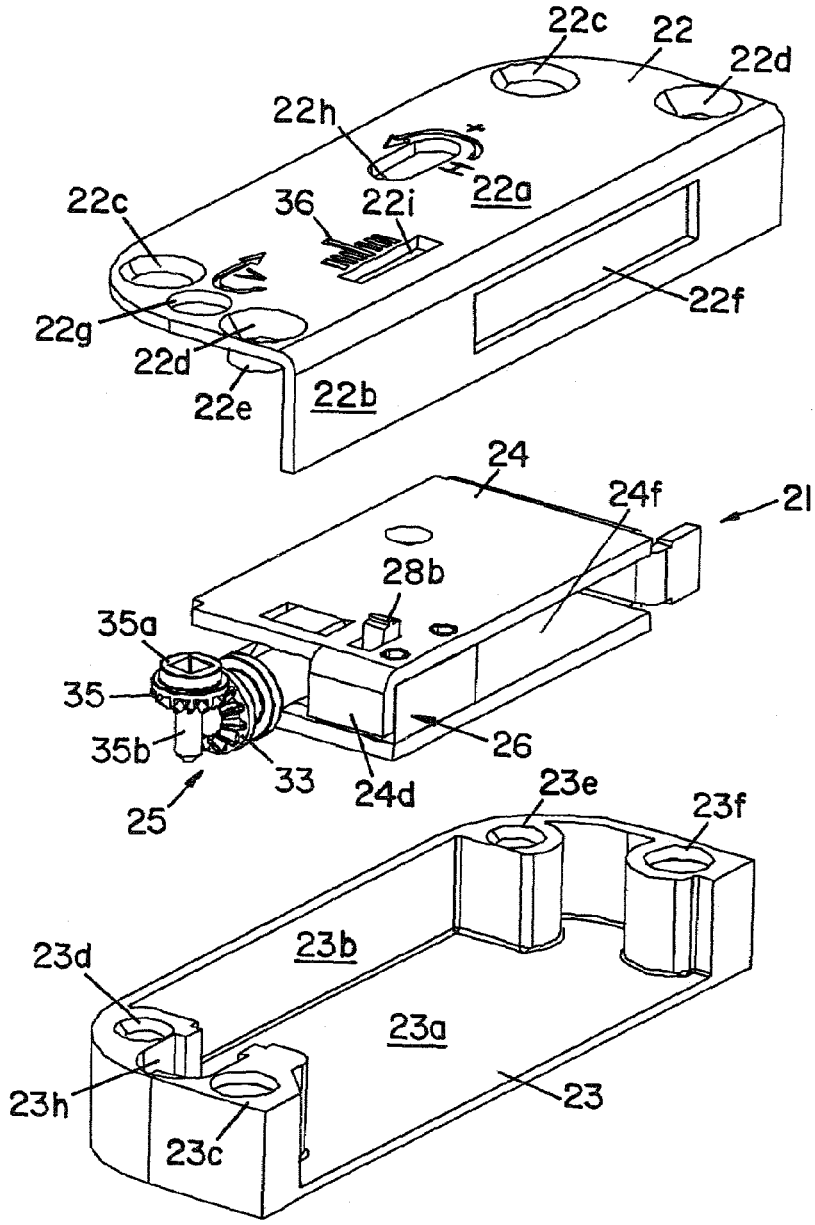
FIG. 4 is an exploded perspective view of the mounting assembly shown in FIG. 1.
Figure 5:
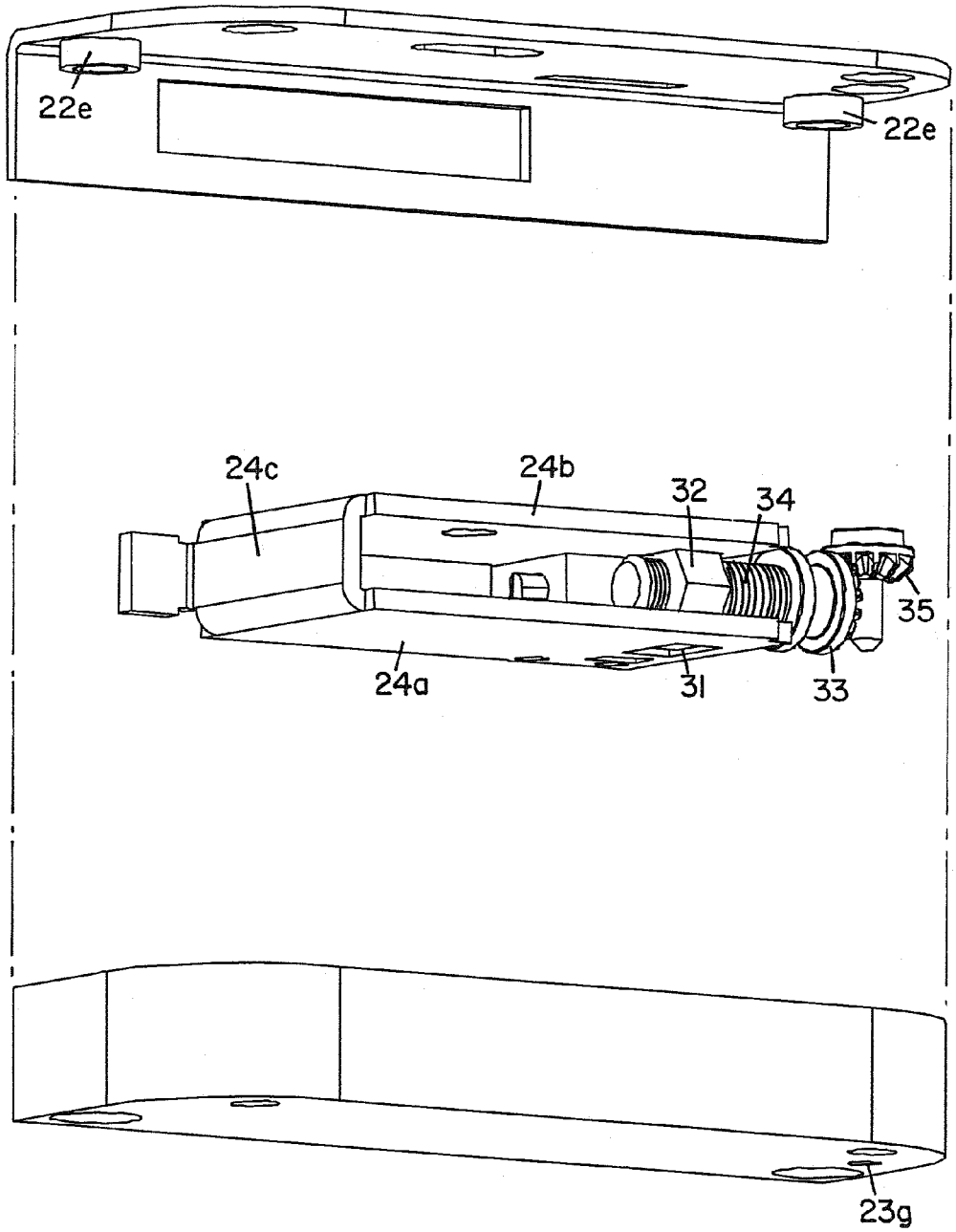
FIG. 5 is an exploded perspective view of the mounting assembly shown in FIG. 4, viewed generally from below.
Figure 6:
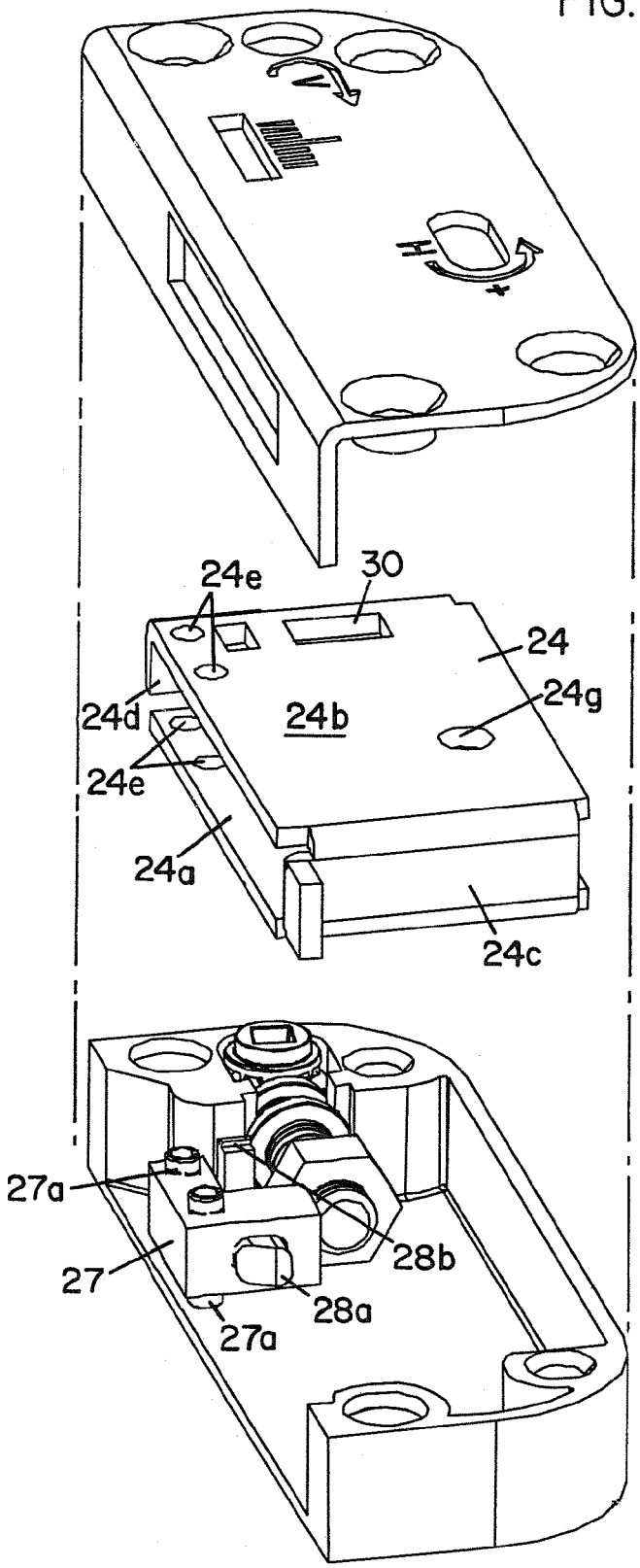
FIG. 6 is an exploded perspective view of the mounting assembly shown in FIG. 4, with the moveable carriage removed but showing the gears and latch mechanism in the bottom.
Figure 7:
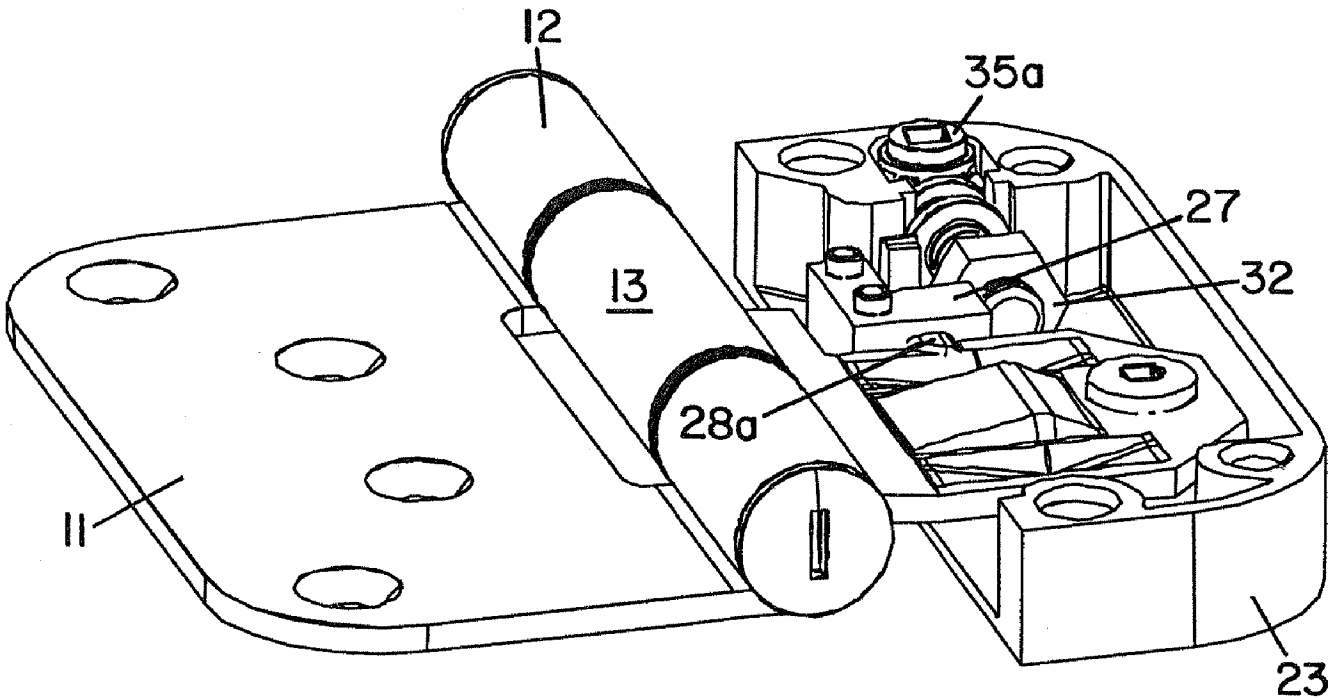
FIG. 7 is a perspective view showing the door leaf positioned in the mounting assembly, with the carriage completely removed.
Figure 8:
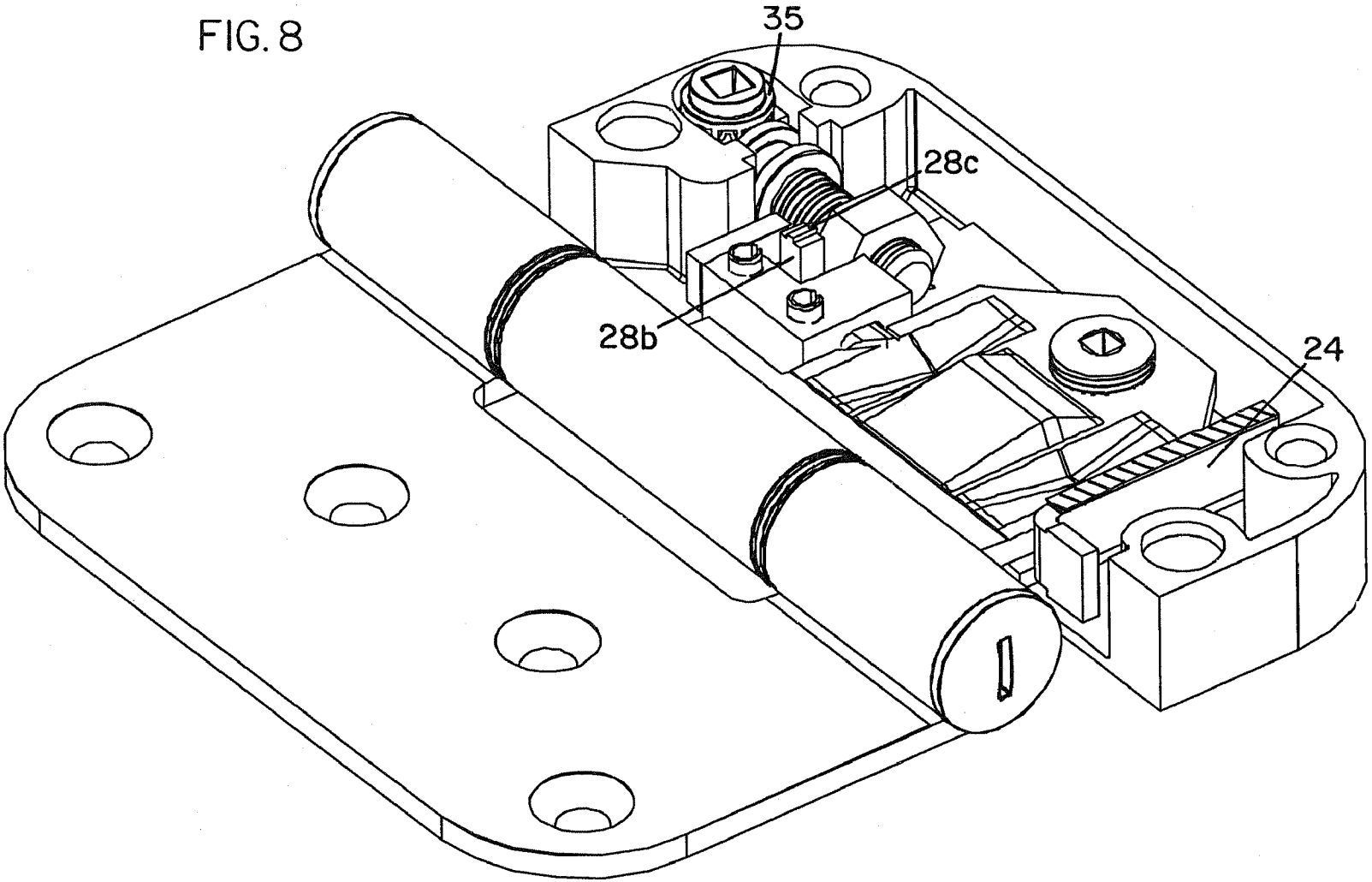
FIG. 8 is a perspective view of the door leaf positioned in the carriage, with the carriage top removed.

Referring now, especially to FIGS. 4-8, there is shown an adjustable mounting assembly 21. The adjustable mounting assembly 21 is adapted and configured to be mounted to a door panel (not shown). The adjustable mounting assembly 21 includes a housing formed by a top member 22 and a bottom member 23. A slideable carriage 24 is positioned in the cavity formed by the top member 22 and bottom member 23. In FIGS. 4 and 5, a bevel gear assembly 25 and latch mechanism 26 is shown positioned in the slideable carriage 24. In FIGS. 6 and 7, the bevel gear assembly 25 and latch mechanism 26 is shown in place in the bottom member 23 with the carriage 24 removed. However, this is shown only for illustrative purposes, it being recognized that the assembly is generally positioned as shown in FIGS. 4 and 5. FIG. 8 shows the bevel gear assembly 25 and latch mechanism 26 in the bottom member 23 also for illustrative purposes. In FIG. 8, the top portion of the slideable carriage 24 has been removed so that the assemblies may be seen in position.

Figure 9:
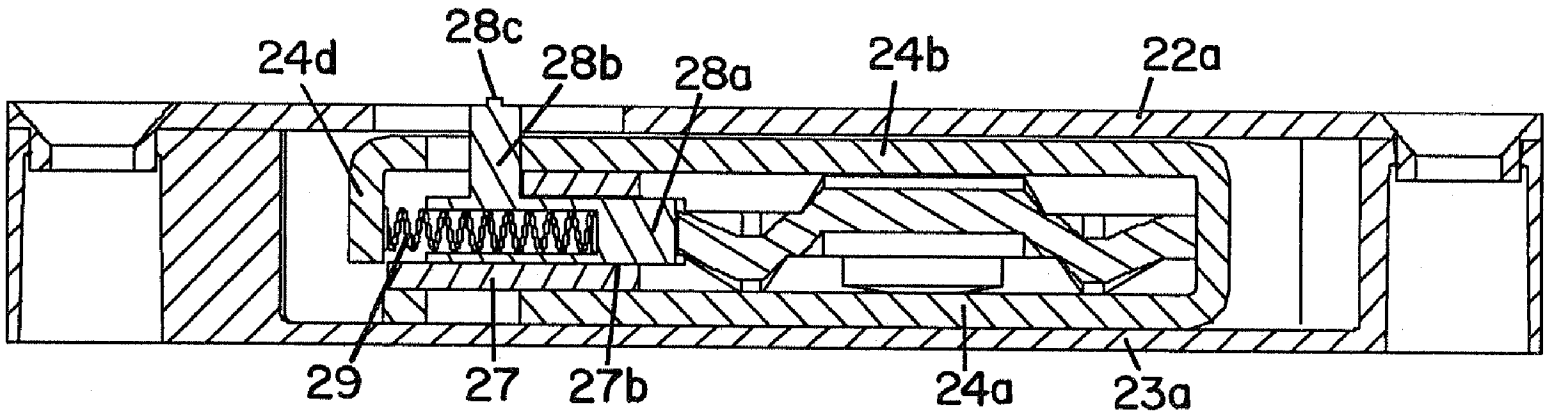
FIG. 9 is a cross-sectional view, taken generally along the lines 9-9.

The slideable carriage 24 is generally a rectangular box, as best seen in FIG. 6. The slideable carriage 24 has a bottom member 24*a*, top member 24*b*, a first side 24*c* and a second side 24*d*. Preferably, this is formed from a single piece. It is appreciated that prior to completion of the bending of a single piece to form the box, the various components that are in the carriage may be required to be in position. Alternately, the carriage could be formed from multiple parts and later connected to form the carriage. As can be seen in FIG. 4, the side 24*d* extends only across a portion of the width of the carriage 24. Four mounting holes 24*e* are formed in the carriage 24, two in the top member 24*b* and two in the bottom member 24*a*. The mounting holes 24*e* are used to secure a latch block 27 in position. A generally L-shaped latch block 27 has four protrusions 27*a*, only three of which are shown in FIG. 6. The protrusions 27*a* are sized and configured to fit in the mounting holes 24*e*. The latch block 27 is positioned between the bottom member 24*a* and top member 24*b* and then compressed and a friction fit is formed to secure the latch block 27 in position. An L-shaped latch 28 has a latch member 28*a* operatively connected to a release member 28*b*. The latch member 28*a* is positioned in a bore 27*b* formed in the latch block 27. A spring 29 is positioned in a bore in the latch block 28 between the inside of the second side 24*d* and the end of the bore in latch block 28, thereby biasing the latch member 28*a* in a latched position, as shown in FIG. 9. There is enough compression left in the spring 29 so that the release member 28*b* may be pulled toward the second side 24*d*, thereby compressing the spring and moving the latch member 28*a* further into the latch block 27. The top of the release member 28*b* has a raised section 28*c* that acts as a pointer, as will be described more fully hereafter.

The top member 24*b* has a nut opening 30 and the bottom member 24*a* has a similar nut opening 31. A nut 32 is positioned, between the nut openings 30 and 31 such that it is captured in the openings 30, 31 and cannot rotate. A portion of the nut 32 extends into both of the openings 30 and 31. A second bevel gear 33 has a threaded rod 34 operatively connected thereto. The threaded rod 34 is threaded through the nut 32. A first bevel gear 35 is positioned to mesh with the second bevel gear 33, such that rotation of the first bevel gear 35 will cause rotation of the-second bevel gear 33, which is at 90 degrees thereto, although it is understood other angles may also be utilized. This will in turn cause rotation of the threaded rod within the nut 32. The first bevel gear 35 has an end cap 35*a* with a square opening that is adapted and configured to be rotated by a suitable means, such as an Allen wrench.

The adjustable mounting assembly 21 has a housing formed by the top member 22 and the bottom member 23. Referring now especially to FIGS. 4 and 5, the bottom 23 is generally rectangular and has a base 23*a* with a wall 23*b* that is operatively connected thereto and forms a wall on three sides of the base 23*a*. Four bosses 23*c*-23*f* are formed in the wall 23*b*. Each of the bosses 23*c*-24*f* have bores formed therein. Another hole 23*g* is formed in the base 23*a*. The hole 23*g* is sized and configured to receive the end of the shaft 35*b* of the first bevel gear 35. Also, a cavity 23*h* is formed by the wall 23*b*. The cavity 23*h* is above the hole 23*g* and the cavity 23*h* provides for a receptacle for the first bevel gear 35.

The top member 22 has a planar member 22*a* operatively connected to a wall 22*b*. The planar member 22*a* has two tapered holes 22*c* that positioned over bosses 23*d* and 23*e*. Two other holes 22*d* also have a tapered surface at the top but also have an additional cylindrical member 22*e* that depends below the bottom surface of the wall 22*b*. When the top member 22 is joined to the bottom member 23, the cylindrical members 22*e* are positioned in the holes of the bosses 23*c* and 23*f* and pinned to secure the top member 22 to the bottom member 23. The wall 22*b* has a rectangular opening 22*f* that is sized and configured to receive the door leaf 14. The rectangular opening 22*f*, when assembled, is over a corresponding opening 24*f* in the slideable carriage 24. A first access opening 22*g* is formed in the planar member 22*a*. The first access opening 22*g* allows access for a tool to be inserted into the end cap 35*a* of the first bevel gear 35. A second access opening 22*h* is formed in the planar member 22*a*. This provides an access opening to the opening 17*a* of the screw 17. Finally, a third access opening 22*i* is also formed in the planar member 22*a*. This provides for access to the release member 28*b* of the latch 28. This third access opening 22*i* is also an indicator opening as a plurality of linearly spaced markings 36 are imprinted or otherwise placed on the planar member 22*a*.

The top member 22 and bottom member 23 form the housing which has a cavity which is sized and configured to receive the slideable carriage 24. As can be best seen in FIGS. 10-12, the walls 22*b* and 23*b* are spaced at a distance to be just slightly larger than the width of the slideable carriage 24. Also, in viewing FIG. 9, it can be seen that the height of the vertical carriage 24 is again just slightly less than the distance between the planar member 22*a* and base 23*a*, thereby further defining a path for the carriage 24 to slide. This provides for a path in which the slideable carriage 24 may slide in a direction parallel to the access of the pin 15. However, as can been seen in FIG. 8, there is room for the carriage 24 to move to allow for vertical adjustment, as will be described in more detail hereafter.

In operation, the leaf frame 11 is mounted to the frame of a door by screws through mounting holes 11*a*. Similarly, the adjustable mounting assembly 21 is mounted by suitable screws to a door through the holes 22*c*, 22*d*. It is preferred that the door be notched so that the adjustable mounting assembly 21 is more flush with the edge of the door. Such mountings are well known in the art and therefore are not shown in the drawings. Typically, three adjustable hinges 10 are used for each door. Further, it is recognized that the adjustable hinge 10, described thus far, has both a vertical and a horizontal adjustment. It is understood that either the horizontal or vertical features may be removed from the hinge, leaving a hinge that would not adjust both horizontally and vertically. Instead, a hinge could only adjust vertically or horizontally. In such a scenario, typically two horizontally adjustable hinges would be used, one at the top of the door and the other at the bottom of the door. A vertically adjustable hinge would then be used in the middle.

Once all of the adjustable hinges 10 that are to be used are mounted, the door is moved in position and the door leaf insertion member 14*b*, with the leading edge 14*c* in front, is moved into the slideable carriage 24 through the opening 24*f*. As the insertion member 14*b* moves into the slideable carriage 24, the top edge 14*d* will make contact with the latch member 28*a* and move the latch member 28*a* from a latched position to an unlatched position, compressing the spring. Then, as the insertion member 14*b* continues to be inserted into the slideable carriage 24, the latch member 28*a* will pass over the latch receiving opening 14*f* and the spring 29 will urge the latch member 28*a* to a latched position and catch on the latch receiving opening 14*f*. This will secure the door leaf 14 into the adjustable mounting assembly 21 and prevent removal unless the release member 28*b* is moved. It is appreciated that location of the end wall 14*g* on the insertion member 14*b* is determined so as to have a minimal amount of movement of the leaf 14 after the leaf 14 has been secured in position. It is appreciated the latch receiving opening may also be formed on the bottom edge 14*e*, in which case the latch mechanism would be moved to the other side also.

Figure 10:
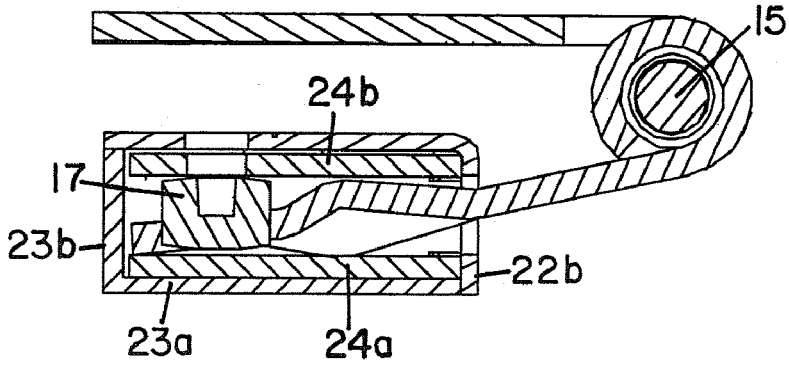
FIG. 10 is a cross-sectional view of the adjustable hinge shown in FIG. 1 to show a horizontal adjustment for a maximum panel gap.
Figure 11:
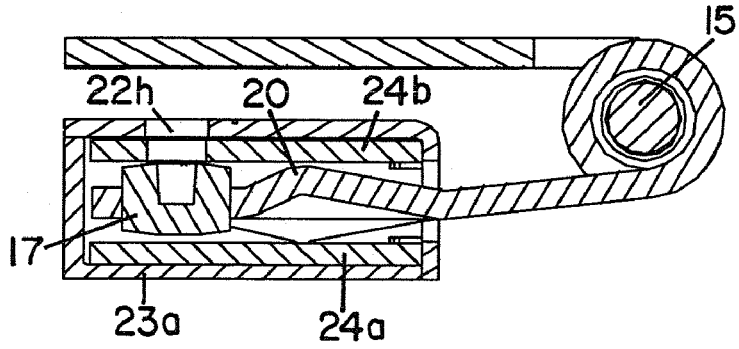
FIG. 11 is a cross-sectional view of the adjustable hinge shown in FIG. 1 to show a horizontal adjustment for a neutral panel gap.
Figure 12:
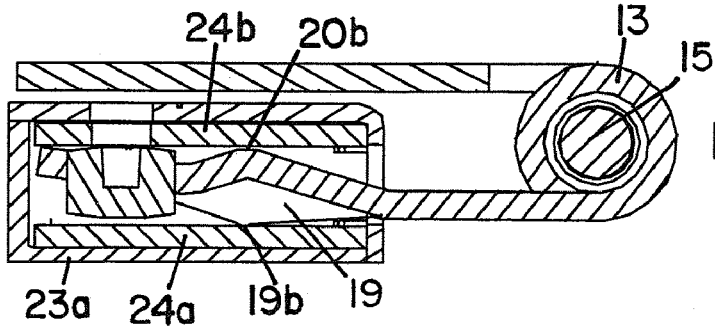
FIG. 12 is a cross-sectional view of the adjustable hinge shown in FIG. 1 to show a horizontal adjustment for a minimum panel gap.
Figure 13:
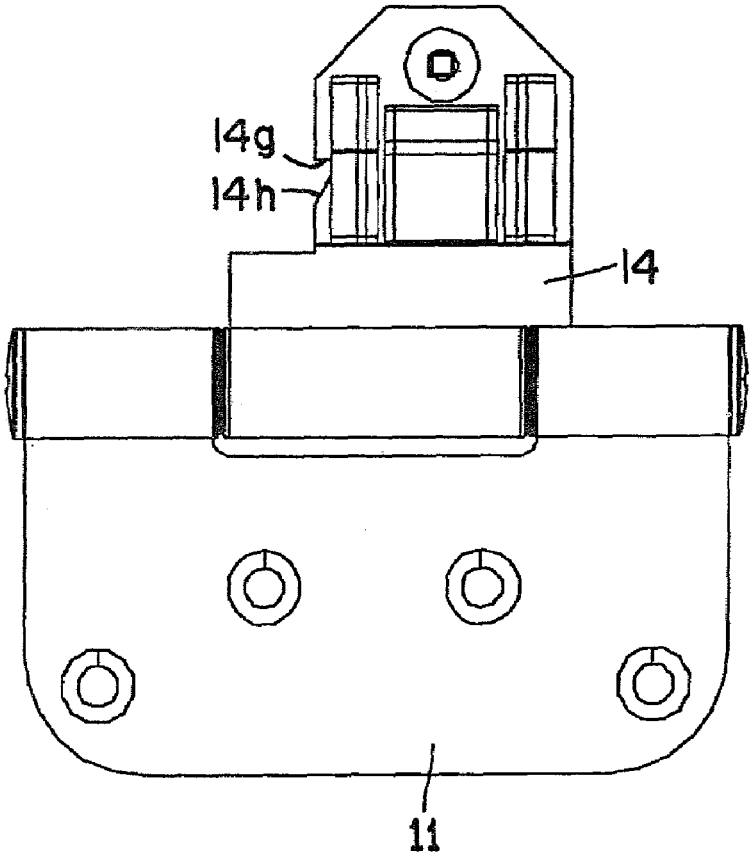
FIG. 13 is a top plan view of the frame leaf and door leaf shown in FIG. 2.

Referring now especially to FIGS. 10-12, the horizontal adjustment is shown in sequence. FIG. 12 shows the minimum panel gap, FIG. 11 the neutral panel gap and FIG. 10 the maximum panel gap. The horizontal adjustment is accomplished by placing a suitable tool through the opening 22*h* and then 24*g* to reach the opening 17*a* of the screw 17. Then, if it is desired to move the leaves further apart, the screw 17 is rotated counterclockwise and clockwise if the leaves are to be brought closer together. The movement of the leaves is affected because the screw 17 does not move up or down, as shown in FIG. 10. The screw is substantially the same height as the distance between the top member 24*b* and the bottom member 24*a*. Instead, the screw rotates and the threaded bore 18 causes the end of the door leaf 14 to move up or down. If the door leaf 14, at its end, moves down, the door leaf 14 pivots on the apexes 19*b* of the protrusions 19 on member 24*b*. If the end of the door leaf 14 moves upward, as shown in FIG. 12, the door leaf 14 will pivot on the apex 20*b* of protrusion 20 on member 24*a*. The coined protrusions give an overall thickness of approximately the distance between members 24*a*, 24*b*.

Referring now to FIGS. 1, 4, 7 and 8, the vertical adjustment will be described. It should be recognized that in FIG. 7, the slideable carriage 24 has been removed. Further, in FIG. 8 the bottom member 24*b* has been removed so as to better show the working of the adjustable hinge 10. To adjust the adjustable hinge 10 vertically, a suitable tool is placed in the end cap 35*a* and rotated. Rotation to the right will move the slideable carriage to the right, as shown in FIG. 8. Rotation of the first bevel gear 35 causes the second bevel gear 33, which is at 90 degrees, to rotate. This in turn causes the rotation of the threaded rod 34. Since the nut 32 is captured in the nut opening 30 and 31, rotation of the threaded knob will cause the nut 32 to move up and down the threaded rod 34. This in turn carries with it the carriage 24. Since the door leaf 14 is secured in the slideable carriage 24 by the latch mechanism 26, the door leaf 14 moves along with the slideable carriage 24 and allows for vertical adjustment. It is appreciated that the nut 32 could take other forms. For instance, there could be a threaded member that was operatively connected to the carriage 24. The threaded rod would then be positioned in the threaded member. The nut 32 is just one example of a threaded member that may be utilized. Further, the nut openings 30 and 31 are just one way of operatively connecting the threaded member, or nut, to the slideable carriage 24.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An adjustable hinge for pivotally mounting a door to a frame, comprising:

(a) a first leaf adapted and configured to be mounted on one of a frame and a door;

(b) an adjustable mounting assembly adapted and configured to be mounted on the other of the frame and door, the adjustable mounting assembly comprising:

(i) a housing defining an inner cavity;

(ii) a slideable carriage positioned in the inner cavity, the carriage generally constrained in the inner cavity by the housing; and (iii) a receptor cavity formed in the slideable carriage;

(c) a second leaf having a first end operatively connected to the first leaf and rotatably connected thereto; and (d) the second leaf having a second end operatively connected in the receptor cavity to the slideable carriage, the second end in a relative fixed position in the receptor cavity, wherein the hinge is vertically adjustable.

2. The adjustable hinge of claim 1, the second leaf having a snap-in connection to the slideable carriage of the adjustable mounting assembly.

3. The adjustable hinge of claim 2, further comprising:
(a) a latch positioned in the mounting assembly, the latch biased to a latched position, the latch moveable between the latched position and an unlatched position;
(b) the second leaf having a leading edge, a top edge and a bottom edge; and
(c) one of the top edge and the bottom edge having a latch receiving opening, wherein the latch engages the second leaf along the one of the top edge and the bottom edge.

4. The adjustable hinge of claim 3, further comprising:
(a) the second leaf having an inside surface and an outside surface and a threaded bore extending between the surfaces;
(b) the threaded bore proximate the leading edge;
(c) a screw rotatably mounted in the threaded bore; and
(d) a first access opening in the housing to allow for rotating the screw, thereby pivoting the second leaf and horizontally adjusting the hinge.

5. The adjustable hinge of claim 4, further comprising:
(a) a first bevel gear positioned in the housing, the housing having a second access opening allowing for rotation of the first bevel gear;
(b) a second bevel gear coupled to the first bevel gear;
(c) a rod having a threaded end, the rod rotated by the second bevel gear; and
(d) a threaded member operatively connected to the carriage, the threaded member positioned on the threaded end of the rod, wherein rotation of the first bevel gear rotates the rod and moves the threaded member along the rod, and thereby the carriage, vertically.

6. The adjustable hinge of claim 5, wherein the gears are coupled at a 90° angle.

7. The adjustable hinge of claim 6, wherein the threaded member is a nut captured by the carriage.

8. The adjustable hinge of claim 7, further comprising:
(a) the housing having an indicator opening, the opening having markings proximate thereto;
(b) the latch having a release member, the release member being accessible through the indicator opening, whereby the latch is moveable to the unlatched position; and
(c) movement of the carriage moves the release member by the markings, thereby providing a vertical indicator.

9. An adjustable hinge for pivotally mounting a door to a frame, comprising:
(a) a first leaf adapted and configured to be mounted on one of a frame and a door;
(b) an adjustable mounting assembly adapted and configured to be mounted on the other of the frame and door, the adjustable mounting assembly comprising:
(i) a housing defining an inner cavity;
(ii) a slideable carriage positioned in the inner cavity, the carriage generally constrained in the inner cavity by the housing;
(iii) a receptor cavity formed in the slideable carriage,
(iv) a latch positioned in the mounting assembly, the latch biased to a latched position, the latch moveable between the latched position and an unlatched position;
(c) a second leaf having a first end operatively connected to the first leaf and rotatably connected thereto;
(d) the second leaf having a second end operatively connected to the slideable carriage with a snap-in connection in the receptor cavity, the second end in a relative fixed position in the receptor cavity wherein the hinge is vertically adjustable;
(e) the second leaf having a leading edge, a top edge and a bottom edge; and
(f) one of the top edge and the bottom edge having a latch receiving opening, wherein the latch engages the second leaf along the one of the top edge and the bottom edge.

10. The adjustable hinge of claim 9, further comprising:
(a) the housing having an indicator opening;
(b) the latch having a release member, the release member being accessible through the indicator opening, whereby the latch is moveable to the unlatched position; and
(c) movement of the carriage moves the release member in the indicator opening, thereby providing a vertical indicator.

11. The adjustable hinge of claim 10, further comprising the indicator opening having markings proximate thereto.

12. An adjustable hinge for pivotally mounting a door to a frame, comprising:
(a) a first leaf adapted and configured to be mounted on one of a frame and a door;
(b) an adjustable mounting assembly adapted and configured to be mounted on the other of the frame and door, the adjustable mounting assembly comprising:
(i) a housing defining an inner cavity;
(ii) a slideable carriage positioned in the inner cavity, the carriage generally constrained in the inner cavity by the housing;
(iii) a latch positioned in the mounting assembly, the latch biased to a latched position, the latch moveable between the latched position and an unlatched position; and
(iv) a receptor cavity formed in the slideable carriage;
(c) a second leaf having a first end operatively connected to the first leaf and rotatably connected thereto;
(d) the second leaf having a second end operatively connected in the receptor cavity to the slideable carriage with a snap-in connection in the inner cavity, the second end in a relative fixed position in the receptor cavity wherein the hinge is vertically adjustable;
(e) the second leaf having a latch receiving opening, wherein the latch engages the second leaf;
(f) the second leaf having an inside surface and an outside surface and a threaded bore extending between the surfaces, the second leaf having a leading edge, a top edge and a bottom edge, and one of the top edge and the bottom edge having a latch receiving opening, wherein the latch engages the second leaf along the one of the top edge and the bottom edge;
(g) the threaded bore proximate the leading edge;
(h) a screw rotatably mounted in the threaded bore; and
(i) a first access opening in the housing to allow for rotating the screw, thereby pivoting the second leaf and horizontally adjusting the hinge.

13. The adjustable hinge of claim 12, further comprising:
(a) a first raised portion on a top surface of the second leaf;
(b) a second raised portion on a bottom surface of the second leaf, wherein the second leaf pivots on one of the raised portions for horizontal adjustment.

14. An adjustable hinge for pivotally mounting a door to a frame, comprising:
(a) a first leaf adapted and configured to be mounted on one of a frame and a door;
(b) an adjustable mounting assembly adapted and configured to be mounted on the other of the frame and door, the adjustable mounting assembly comprising:
(i) a housing defining an inner cavity;
(ii) a slideable carriage positioned in the inner cavity, the carriage generally constrained in the inner cavity by the housing; and
(iii) a receptor cavity formed in the slideable carriage;

(c) a second leaf having a first end operatively connected in the receptor cavity to the first leaf and rotatably connected thereto;

(d) the second leaf having a second end operatively connected to the slideable carriage, the second end in a relative fixed position in the receptor cavity;

(e) a first bevel gear positioned in the housing, the housing having a second access opening allowing for rotation of the first bevel gear;

(f) a second bevel gear coupled to the first bevel gear;

(g) a rod having a threaded end, the rod rotated by the second bevel gear; and (h) a threaded member operatively connected to the carriage, the threaded member positioned on the threaded end of the rod, wherein rotation of the first bevel gear rotates the rod in the threaded member, and thereby the carriage, vertically.

15. The adjustable hinge of claim 14, wherein the threaded member is a nut captured by the carriage.

16. The adjustable hinge of claim 15, wherein the gears are coupled at a 90° angle.

17. The adjustable hinge of claim 14, the second leaf having a snap-in connection to the slideable carriage of the adjustable mounting assembly.

* * * * *